United States Patent [19]

Coulston

[11] Patent Number: 4,932,183

[45] Date of Patent: Jun. 12, 1990

[54] BELLOWS SPLICE SLEEVE

[75] Inventor: E. L. Coulston, Norcross, Ga.

[73] Assignee: Kawneer Company, Inc., Norcross, Ga.

[21] Appl. No.: 300,082

[22] Filed: Jan. 19, 1989

[51] Int. Cl.[5] ..... E04B 1/68

[52] U.S. Cl. ..... 52/417; 52/396; 52/573

[58] Field of Search ..... 52/395, 396, 416, 417, 52/418, 573

[56] References Cited

U.S. PATENT DOCUMENTS

| | | | |
|---|---|---|---|
| 1,357,713 | 11/1920 | Lane | 52/396 |
| 3,128,576 | 4/1964 | Bradley | 52/396 |
| 3,192,577 | 7/1965 | Barr | 52/573 |
| 3,398,494 | 8/1968 | Larson | 52/573 |
| 3,455,077 | 7/1969 | Long . | |
| 4,563,849 | 1/1986 | Mangal . | |
| 4,651,488 | 3/1987 | Nicholas . | |

FOREIGN PATENT DOCUMENTS

| | | | |
|---|---|---|---|
| 2344225 | 3/1975 | Fed. Rep. of Germany | 52/573 |
| 1309406 | 10/1962 | France | 52/396 |

*Primary Examiner*—John E. Murtagh

*Attorney, Agent, or Firm*—Jones, Askew & Lunsford

[57] ABSTRACT

The invention is directed to a watertight expandable and contractible splice joint for use in expansion joints of metal framing systems for storefronts, curtainwalls, and windows, and which accommodates expansion and contraction without extreme deformation in the expansion joint to avoid failure of joint sealant. Accordingly, the invention provides an expandable splice joint in framing systems, which includes two framing members secured in closely spaced relationship forming an expansion space therebetween; and an elongated splice sleeve strip having planar side portions about a central flexible bellows-like portion; the planar side portions being sealed to the framing members alongside the expansion space, respectively, and the bellows portion lying in and along the expansion space.

7 Claims, 2 Drawing Sheets

BELLOWS SPLICE SLEEVE

TECHNICAL FIELD

This invention relates generally to expansion joints in building construction and relates more specifically to an expandable splice sleeve for sealing expansion joints in metal framing systems.

BACKGROUND OF THE INVENTION

In metal framing systems for storefronts, curtainwalls, and windows, the framing members utilized in such construction are typically extruded aluminum profiles. Since such metal framing profiles form the facade of a building and are therefore directly exposed to the weather elements, the framing members are subject to thermal expansion and contraction. It is therefore conventional practice to provide a small expansion space between abutted framing members in long runs of lineal framing to accommodate such thermal expansion, particularly in the sill and header components of the framing system.

Such expansion joints must be sealed so that they are watertight and airtight to maintain the functional integrity of the framing. According to conventional practice, an expansion joint is covered by a thin metal plate that has one end bonded to one of the abutting framing members with a curing sealant. This other end is separated from the other framing member with a non-drying, non-curing mastic that serves as a sealant. Initially, this joint seal functions properly. However, under repeated thermal cycling and exposure to the elements over time, the seal tends to rupture, compromising the integrity of the joint.

Thus, there is a need to provide a seal for expansion joints in metal framing systems which will not rupture under repeated movement and exposure to the elements.

SUMMARY OF THE INVENTION

It is a primary object of this invention to provide a watertight expandable and contractible splice joint for use in expansion joints of metal framing systems for storefronts, curtainwalls, and windows, and which accommodates expansion and contraction without producing high stresses in the expansion joint to avoid failure of the joint seal.

Accordingly, the present invention provides an expandable joint cover for use in sealing expansion joints of metal framing systems used in storefronts, curtainwalls, windows, and the like. The joint cover comprises an elongated splice sleeve strip having a pair of opposing, longitudinal extending planar side portions joined by a central flexible bellows portion. The planar side portions are sealed to the framing members along either side of the expansion joint, and the bellows lies within and spans the joint to provide an airtight and watertight seal.

Preferably, the planar side portions define holes therein to permit sealant to flow from the underside to the upperside of the planar side portions during installation of the splice sleeve. The bond between the sealant and the lateral edges of these holes enhances the shear strength of the adhesive bond between the splice sleeve and the respective framing members. Additionally, the holes promote the curing of the sealant by providing access to the air and moisture needed for the curing of many sealants.

In the disclosed embodiment, each of the planar side portions further includes longitudinal setting strips along the edges and on the underside of each planar side portion. The setting strips are configured to elevate the planar side portions slightly above their respective framing members to form pockets for the sealant.

The splice sleeve of the preferred embodiment includes double sided adhesive tape along the underside of the planar side portions to provide temporary adhesion of the splice sleeve to the framing members while the applied sealant cures.

Other objects, features and advantage of the invention will become apparent upon reading the following detailed description in conjunction with the drawings and the appended claims.

DETAILED DESCRIPTION OF THE DISCLOSED EMBODIMENT

Figure 1:
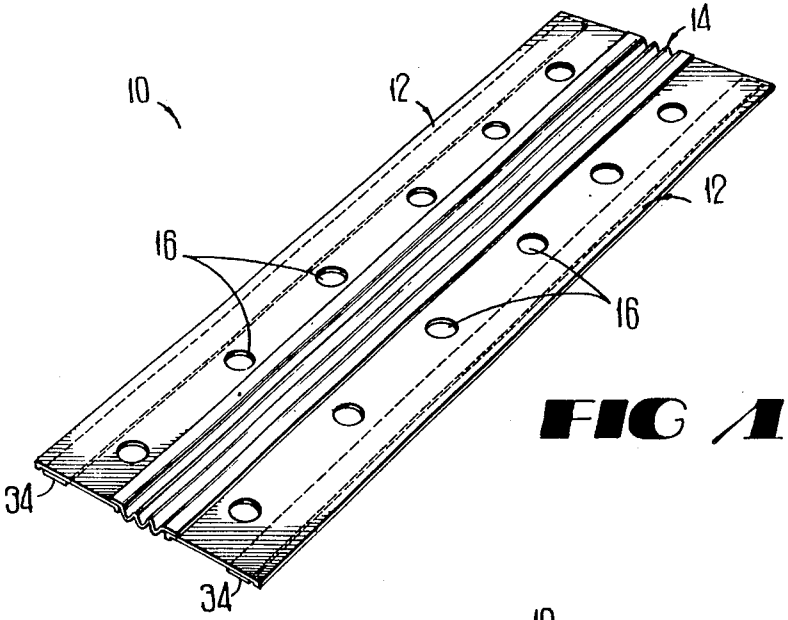
FIG. 1 is a pictorial view of a splice sleeve, according to a preferred embodiment of the invention.

Referring now in detail to the drawings, in which like numerals indicate like elements throughout the several views, FIG. 1 shows a pictorial view of a strip of joint splice sleeve 10, according to a preferred embodiment of the invention. The splice sleeve 10 is an extruded profile and may be cut to the desired segment length, typically about eight inches. The splice sleeve 10 includes planar side portions 12 extending longitudinally along each side of the sleeve. The central portion 14 of the sleeve is bellows-like, that is, the central bellows portion is a relatively flexible, corrugated material which is expandable and contractible across the splice sleeve. The planar side portions 12 and central bellows portion 14 preferably comprise a coextruded profile of thermoplastic material. In the disclosed embodiment, the planar side portions 12 are composed of rigid polyvinyl chloride, while the central bellows portion 14 is composed of a relatively flexible thermoplastic elastomer. However, it will be appreciated that the splice sleeve 10 may be composed of any combination of rigid and flexible thermoplastic materials which may be compatibly coextruded.

The coextrusion of the planar side portion 12 and central bellows portion 14 provides certain advantages other than the obvious manufacturing expedient. It is a primary object of the spice sleeve 10 that it prevent air and water from penetrating an expansion joint. It would be difficult for a mechanical attachment between the bellows and the planar side portions to provide the necessary weatherproofing qualities. However, coextruding the various elements as a unitary profile ensures a continuous and uninterrupted juncture between the central bellows portion and the planar side portions which meets these weatherproofing criteria.

The splice sleeve 10 includes shear holes 16 at regularly spaced intervals along the planar side portions 12. The shear holes 16 of the disclosed embodiment are about 0.25 inch in diameter with a center-to-center spacing of about one inch. The purpose of the shear holes 16 is to permit sealant, during installation of the splice sleeve, to flow from the underside to the upper-side of the planar side portions 12. When the sealant has cured, the bond between the sealant and the lateral edges of the shear holes 16 and the resulting mechanical interlock will enhance shear strength of the installed splice sleeve. In addition, the shear holes 16 permit excess sealant to escape as the splice sleeve is installed. Finally, the shear holes 16 promote curing by providing exposure to air and moisture necessary for curing certain sealants.

Figure 2:
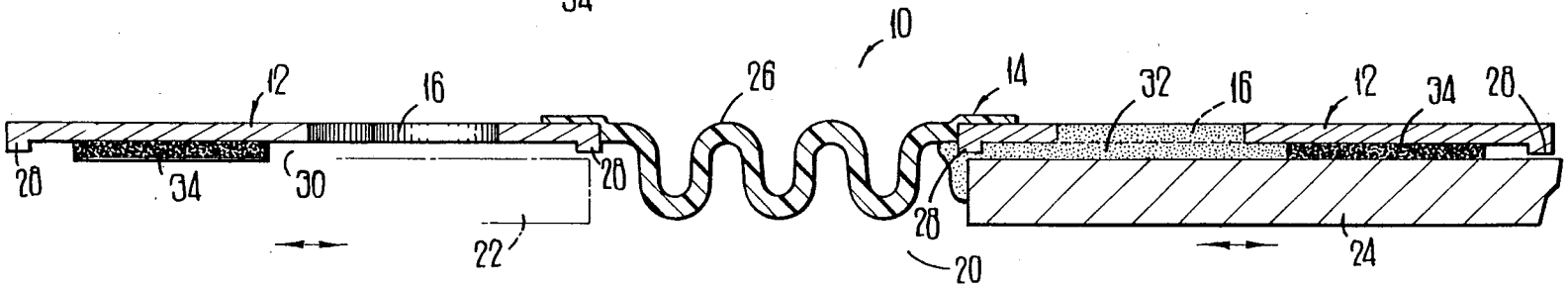
FIG. 2 is a transverse cross-sectional view of the splice sleeve of FIG. 1 installed on an expansion joint between two frame members.

FIG. 2 is a transverse cross-sectional view of the splice sleeve 10 mounted to a horizontal expansion joint 20 between two linear frame members 22, 24 disposed with their longitudinal axes coextensive and their ends in mutually spaced-apart relation. The planar side portions 12 of the splice sleeve 10 are adhered to the upper surfaces of the frame members 22, 24 with the central bellows portion 14 of the sleeve fitting within and spanning the joint 20. The upper bellows surface 26 is configured to lie generally in the plane of the upper surface of the planar portions 12, so that the bellows portion 14 rests within the expansion joint 20, and the splice sleeve has a relatively uniform upper surface overall.

As can be seen in FIG. 2, the planar side portions 12 include setting strips 28 extending longitudinally along and under each edge of the planar side portions 14. The purpose of the setting strips 28 is to elevate the splice sleeve 10 slightly above the framing members 22, 24 onto which the splice sleeve is mounted to form a sealant pocket 30 under the planar side portions 12. The sealant pocket 30 is filled with a pliable structure sealant such as structural silicon sealant 32. Preferably, the structural silicone sealant has a low modulus of elasticity so as to stretch and compress easily with low stress and without fracturing. The setting strips 28 also facilitate the affixment of double sided adhesive tape 34 under each planar side portion 12. The purpose of the adhesive tape 34 is to provide temporary adhesion of the splice sleeve 10 to the respective framing members 22, 24 during installation while applied sealant cures. This is further discussed below.

The planar side portions of the disclosed embodiment are about 0.775 inch in width and about 0.025 inch in thickness. The setting strips are about 0.015 inch in height, so that the overall height of the planar side portions is about 0.040 inch. The central bellows portion is preferably about 0.480 inch width by about 0.125 inch height in the relaxed condition, so that preferred overall width of the splice sleeve is about 2.03 inches. The undulations of the bellows portions have a peak-to-trough spacing of about 0.069 inch. The thickness of the bellows material is about 0.025 inch.

Figure 3:
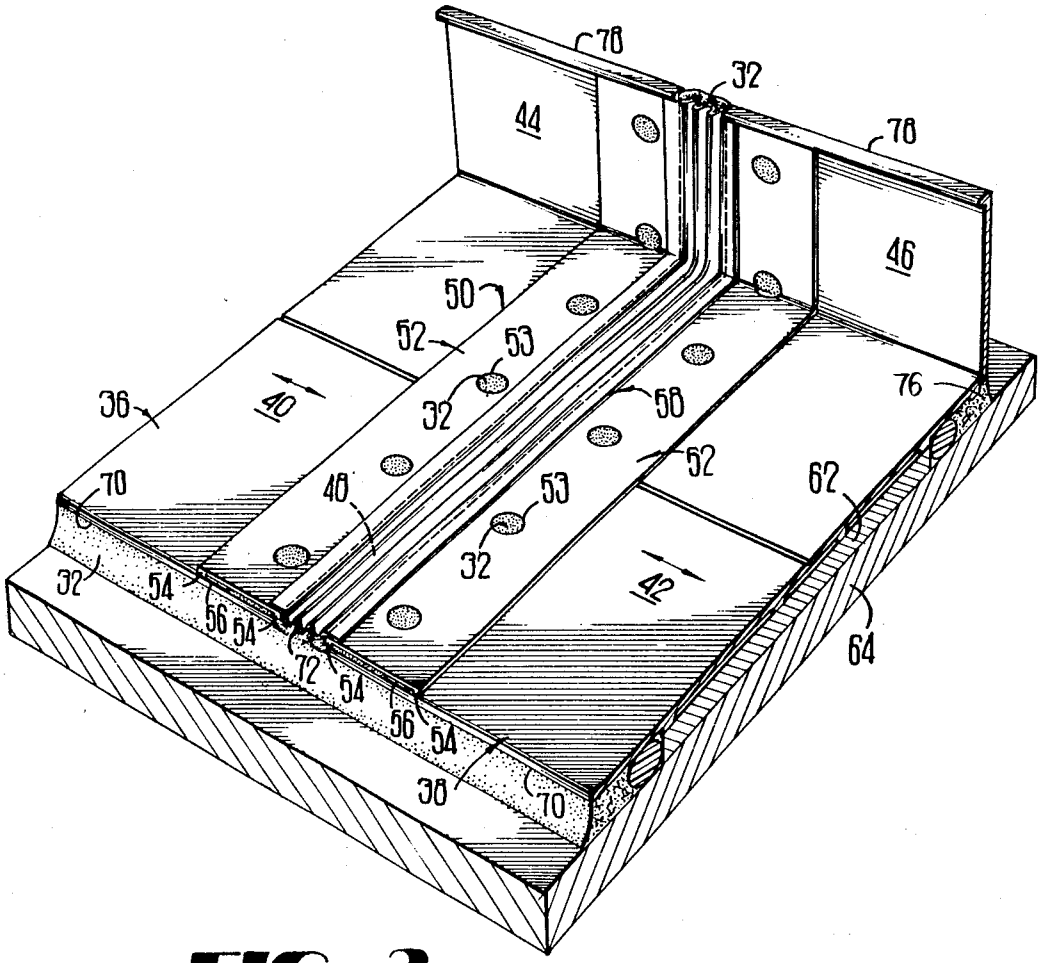
FIG. 3 is a pictorial view of a splice sleeve installed on an L-shaped expansion joint between two sill framing members.

FIG. 3 shows the splice sleeve installed on an expansion joint in a sill component in a curtainwall framing system. The sill framing members 36 and 38 are L-shaped and include horizontal legs 40, 42 and vertical or upright legs 44, 46 respectively. Sill members 36 and 38 are generally arranged end-to-end but with their mutually facing ends slightly spaced apart to leave an expansion space 48, preferably about 0.5 inch. A splice sleeve 50 conforms to the L-shape configuration of the sill framing members. Like the splice sleeve 10 of FIGS. 1 and 2, the splice sleeve 50 includes planar side portions 52 defining a plurality of shear holes 53 therein and having setting strips 54 and double-sided adhesive tape 56 on the underside thereof. The splice sleeve 50 has a central bellows portion 58 disposed within the expansion space 48. The planar side portions 52 of the sleeve 50 are secured to the sill framing members 36, 38 on either side of the expansion space 48 by structural silicone sealant 32 previously described. The sill members 36 and 38 are secured to a shim 62 resting on the building floor 64.

Installation of the splice sleeve of the present invention will now be described with reference to FIG. 3. First, the sleeve 50 is bent to conform to the L-shaped of the expansion space 48, such as by using a putty knife. Next, the joint area is cleaned with solvent to promote sealant adhesion. Then beads of sealant 32 are applied to within about one fourth inch of the ends of the sill members 36, 38 on each side of the expansion space 48. The protective liner is removed from the double-sided adhesive tape 56 on the underside of the splice sleeve 50. The splice sleeve 50 is centered on the expansion space 48, and using a putty knife, the splice sleeve is seated into the L-shaped corner and onto the upper surface of the sill members 36 and 38. As the splice sleeve is sealed, excess sealant will squeeze out through the shear holes 53. A putty knife is used to scrape off the excess sealant from the upper surface of the splice sleeve. The double-sided adhesive tape 56 will hold the splice sleeve 50 in position while the sealant cures. Sealant is then applied along the front edge 70 of the sill members 36, 38 making certain that the sealant is forced into the exposed front edge 72 of the expansion space 48. Optionally, sealant may also be used to fill the vertical portion of the expansion space 48 between the upright legs 44, 46 of the sill members 36, 38, as well as the space 76 beneath the rear edge 78 of the sill members, to present an aesthetically pleasing appearance at the back of the joint. The installation of the airtight and watertight expandable and contractible expansion joint is thereby completed.

As the sill members undergo thermal expansion and contraction, the expansion space will vary, and the bellows portion of the splice sleeve will expand and contract accordingly. Relatively little deformation of the sealant under the planar portions of the splice sleeve will occur during this thermal cycling, since the bellows portion accommodates the expansion and contraction of thermal cycling, thereby avoiding stresses which can cause a rupture of the sealant.

While the invention has been described in detail with particular reference to the disclosed embodiments, it is to be understood that variations and modifications may be utilized without departing from the principles and scope of the invention as defined by the following claims.

What is claimed is:

1. An apparatus for sealing an expansion joint between adjacent elongated structural members disposed in end-to-end relation, comprising:

first and second elongated planar members having upper and lower surfaces, each of said planar members having a lateral edge in the direction of elongation of said planar members, and said planar members being disposed with said upper surfaces thereof substantially coplanar and with said lateral edges in parallel, mutually facing, spaced-apart relation;

an elongated flexible bellows member having opposing lateral edges in the direction of elongation of said bellows member, said bellows member being impermeable to water and air, said lateral edges of said bellows member being attached to said mutually facing lateral edges of said first and second elongated planar members such that said planar members are continuously joined by said flexible bellows member;

said first and second planar members each having a pair of longitudinal ridges formed along said lower surfaces thereof such that when said longitudinal ridges are imposed against the upper surface of said structural members, said lower surface of said planar members are maintained in spaced-apart relation to said upper surfaces of said structural members to form a pocket therebetween; and said first and second planar members each having a plurality of holes formed therethrough transverse to said upper and lower surfaces:

whereby when said longitudinal ridges on said lower surfaces of said first and second elongated planar members are imposed against said upper surfaces of said structural members with said first and second planar members on opposite sides of said expansion joint and said flexible bellows member disposed within said expansion joint, and a sealant is applied within said pocket to bond said first and second planar members to said upper surfaces of said structural members, said sealant fills said plurality of holes to afford increased resistance of said planar members to shear forces, said holes afford exposure of said sealant to the ambient to promote the curing of said sealant, and said apparatus moves with said expansion joint to seal said expansion joint against air and water.

2. The apparatus of claim 1, further comprising strips of double-sided adhesive tape affixed to said lower surfaces of said first and second planar members, whereby said first and second planar members are securable to said upper surfaces of said elongated structural members by said double-sided tape during installation of said apparatus while said sealant cures.

3. The apparatus of claim 1, wherein said bellows member is configured such that its upper surface lies substantially in the plane defined by said coplanar upper surfaces of said first and second planar members.

4. A building construction comprising:

first and second structural members having upper surfaces, said structural members disposed end-to-end with their ends in mutually spaced-apart relation to define an expansion space therebetween; and a sealing device for sealing said expansion space against air and water, comprising first and second elongated planar members having upper and lower surfaces, each of said planar members having a lateral edge in the direction of elongation of said planar members, said planar members being imposed against the upper surfaces of said structural members on opposing sides of said expansion space with said upper surfaces thereof substantially coplanar and said lateral edges in parallel, mutually facing, spaced-apart relation;

said first and second planar members each having a pair of longitudinal ridges formed along said lower surfaces thereof and configured to elevate said lower surfaces of said planar members above said upper surfaces of said structural members, thereby forming a pocket therebetween;

said first and second planar members each having a plurality of holes formed therethrough transverse to said upper and lower surfaces:

an elongated flexible bellows member having opposing lateral edges in the direction of elongation of said bellows member, said bellows member being impermeable to water and air, said bellows member being disposed within said expansion space with said lateral edges thereof being attached to said mutually facing lateral edges of said first and second elongated planar members such that said planar members are continuously joined by said flexible bellows member; and a sealant disposed within said pockets to bond said first and second planar members to said upper surfaces of said structural members, said sealant filling said holes in said planar members to afford increased resistance of said planar members to shear forces, and said holes affording exposure of said sealant to the ambient to promote the curing of said sealant.

whereby said sealing device moves with said expansion joint to seal said expansion joint against air and water.

5. The building construction of claim 4, further comprising strips of double-sided adhesive tape affixed to said lower surfaces of said first and second planar members, whereby said first and second planar members are securable to said upper surfaces of said elongated structural members by said double-sided tape during installation of said sealing device while said sealant cures.

6. The building construction of claim 4, wherein said bellows member is configured such that is upper surface lies substantially in the plane defined by said coplanar upper surfaces of said first and second planar members.

7. The building construction of claim 4, wherein said elongated structural members comprise colinear horizontal framing members.

* * * * *